United States Patent [19]

Colston et al.

[11] 3,965,892

[45] June 29, 1976

[54] UNDERWATER BREATHING APPARATUS

[75] Inventors: John R. Colston, Annapolis; Wilbur J. O'Neill, West Severna Park, both of Md.

[73] Assignee: Westinghouse Electric Corporation, Pittsburgh, Pa.

[22] Filed: Feb. 13, 1975

[21] Appl. No.: 549,567

[52] U.S. Cl. ..... 128/142.3

[51] Int. Cl.[2] ..... A62B 7/00

[58] Field of Search..... 128/142, 142.2, 142.3, 128/142.5, 142.7, 145.8, 204, 146.5

[56] References Cited

UNITED STATES PATENTS 3,515,133 6/1970 Parker ..... 128/142.7

3,859,994 1/1975 Almqvist et al..... 128/142.3

FOREIGN PATENTS OR APPLICATIONS 393,650 2/1922 Germany ..... 128/142.3

*Primary Examiner*—Robert W. Michell
*Assistant Examiner*—Henry J. Recla
*Attorney, Agent, or Firm*—D. F. Straitiff

[57] ABSTRACT

Underwater breathing apparatus which includes means for reducing the power required to operate the pumps that effect flexible-hose interchange of breathing gas to and from a diver and a diving bell. This is accomplished primarily by maintaining a substantially constant differential between the supply and return pressures.

9 Claims, 7 Drawing Figures

UNDERWATER BREATHING APPARATUS

BACKGROUND OF THE INVENTION

1. Field of the Invention:

Underwater breathing apparatus of the closed-loop type wherein a pump system at a diving bell or chamber effects circulation of breathing gas to and from a diver via flexible hoses.

2. Description of the Prior Art:

Insofar as applicants are aware, usual prior art breathing apparatuses of the push-pull closed-loop type having pumping systems circulating breathing gas between diving bell and diver via flexible hoses, umbilicals, commonly operate at constant supply and return pressures at magnitudes sufficient to force the flow of breathing gas to the diver at his deepest depth and to induce return flow of the breathing gas from the diver to the bell at the diver's shallowest depth, while at the same time overcoming the dynamic pressure losses in the bell-to-diver circulatory system. This requires greater than a desired amount of pump-operating power, it tends to create a high noise level, and it requires supply and return hose sizes commensurate with such relatively high pressure and flow operating parameters.

SUMMARY OF THE INVENTION

The present invention, in providing for substantially constant differential between supply and return pressures, affords an economy of pump operation in a closed-loop underwater breathing apparatus heretofore unobtainable in the usual prior art apparatus discussed above, and at the same time contributes to reduction in operating noise and hose size requirements.

DESCRIPTION OF THE PREFERRED EMBODIMENTS

Figure 1:
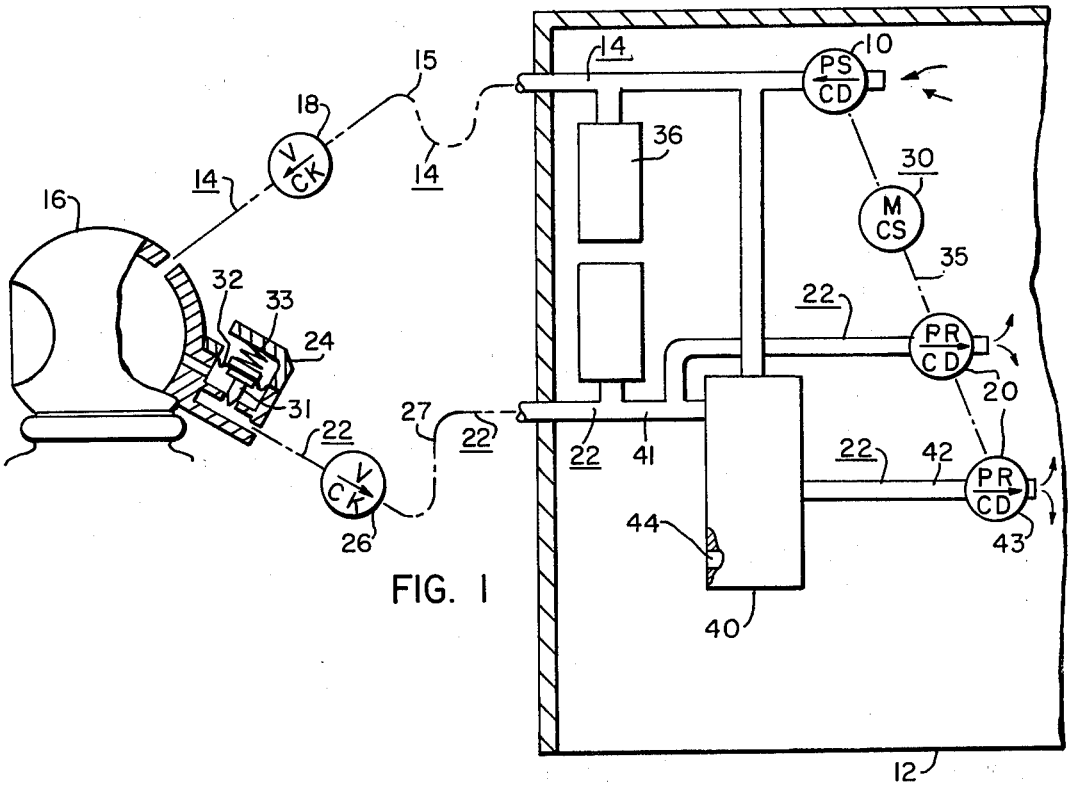
FIGS. 1, 4, 6 and 7 are schematic representations of push-pull underwater breathing apparatus constructed in accord with preferred embodiments of the invention.

Referring to FIGS. 1, 4, 6 and 7 in the drawings, underwater push-pull breathing apparatus with which the several embodiments of the invention are concerned comprises a supply pump means 10 operable to accept breathing gas from the interior of a diving bell 12 and to deliver same to a supply line means 14 which includes a flexible supply hose 15 leading to the interior of a diving helmet 16 via a supply check valve means 18.

Each embodiment also includes a return pump means 20 to effect return of breathing gas from the interior of the helmet 16 back to the interior of the bell 12 by way of a return line means 22 which includes communication through an exhaust control valve device 24, a return check valve means 26 and a flexible return hose

27. Motor means 30 functions to drive the supply and return pump means 10 and 20.

In operation of each embodiment, breathing gas supplied to the supply line means 14 at a sufficient pressure will flow via check valve means 18 to the interior of the helmet 16 and therefrom via exhaust control valve device 24 at a pressure slightly in preponderance of the ambient hydrostatic pressure outside such valve device, whence such gas returns via check valve 26 and return line means 22 to the interior of the bell 12; such exhaust control valve device 24 having an exhaust valve 31 controlling communication between the interior of helmet 16 and return line means 22 in response to operation by a flexible diaphragm 32 subject to helmet pressure on one side and a bias spring 33 force in addition to ambient sea pressure on its other side. At the same time, the bell 12, which takes the usual form of a hollow cylinder, is closed at the top and open at the bottom to accept entering and leaving of divers. The interior of the bell 12 in substantially its entirety is maintained free of water in its submerged state by virtue of pressurization by a gas suitable for breathing by the divers, the gas being at a pressure substantially equal to the water pressure at the bottom of the bell. The means for pressurizing, maintaining, and reconditioning the breathing gas within the bell is not shown in the drawing and may take a number of well-known forms; such means, per se, forming no part of the present invention. Within the bell, a diver may rest, eat, pick up or exchange tools, etc., without need for personal breathing equipment.

In the embodiment of the invention shown in FIG. 1, the motor means 30 is of a constant speed variety and is coupled mechanically to both the supply pump means 10 and to the return pump means 20. In accord with an objective of the present invention, operating energy for the pump means 10 and 20 is conserved by utilizing a type of pump that can function also as a fluid motor to assist the drive motor means 30 under suitable operating conditions of the system. For example, when the diver is above the bell 12, the hydrostatic pressure at the helmet 16, hence also within such helmet due to operation of the exhaust control valve device 24, will be less than the hydrostatic pressure at the bell, and at times, sufficiently less to enable the higher bell pressure to drive the pump means 10 as a fluid motor which acts to assist the motor means 30 in operating the return pump means 20. Similarly, when the diver is below the diving bell 12, the hydrostatic pressure at the helmet 16, as supplied by the supply pump means 10, will be higher than at the bell, and at times, sufficiently higher to operate the return pump means 20 as a fluid motor means for assisting the motor means 30 in operating the supply pump means 10. This motor mode of operation of the two pump means 10 and 20 occurs automatically, according to the degree and direction of preponderance of pressure across such pump means. A type of pump suitable for such dual mode of operation is exemplified in FIG. 3 where radially retractable rotor vanes **32*a* slidably seal at their outer tips against the interior of a cylindrical housing wall 33*a* during rotary movement of an eccentrically mounted rotor 34 which carries such vanes in radial slots. While the rotor 34 is being driven mechanically via a shaft 35, the vanes 32*a* sweeping through the enlarged clearanceway between rotor 34 and cylinder wall 33*a*** causes a movement of gas therethrough either in a supply sense or an exhaust sense, as the case may be. In the motor mode, a preponderance in pressures across the pump creates a force on the vanes 32*a* which turns them to develop a torque output in the shaft 35 to assist the motor means 30.

Figure 3:
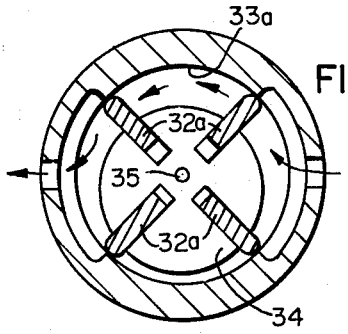
FIG. 3 is a schematic representation of a rotary pump suitable for use as a fluid motor in addition to use as a fluid pump, in the invention embodiment of FIG. 1; and, FIG. 5 is a schematic representation of another valve device suitable for use in the invention embodiment of FIGS. 1, 4 and 7.

In accord with other features of the FIG. 1 embodiment, the dynamic output capacity of the supply pump means 10 can be reduced somewhat by use of accumulator means 36 which functions to store pump output gas during the diver's exhalations for supply assist during inhalations. in addition, the return pump means 20 comprises several pumps of the type shown in FIG. 3 under the control of a differential pressure responsive valve device 40 which operates in behalf of maintaining a certain differential in pressure between the supply line means 14 and the return line means 22. This is accomplished by controlling communication between a common portion 41 of the return line means 22 and a portion 42 leading to the lower one 43 of the return pump means 20. When the pressure in the supply line means 10 tends to predominate over the pressure in the return line means 22 excessively, the differential pressure responsive valve device 40 responds to decrease communication between portions 41 and 42 of the return line means 22 and to increase communication between such portion 42 and a port 44 open to the bell 12. This has the effect of tending to ineffectuate the lower return pump 43 with respect to its effect on the return line means by reducing its degree of openness thereto while increasing bypass connection to the bell.

Figure 2:
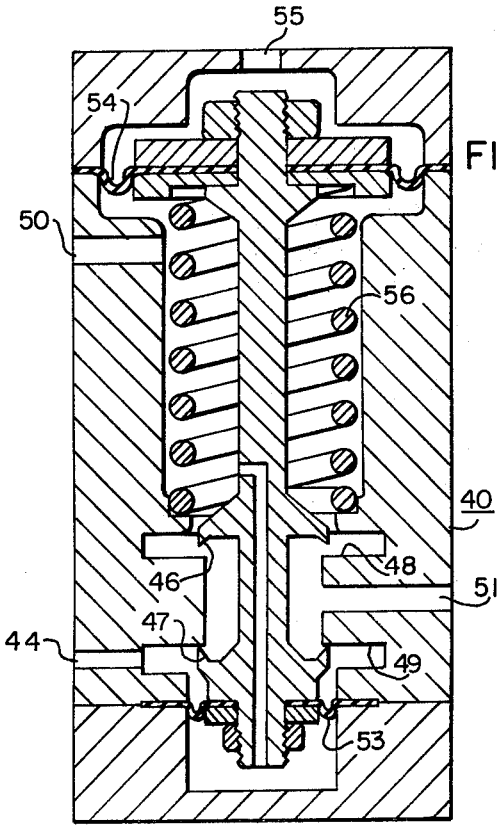
FIG. 2 is a schematic representation of a valve device used in the invention embodiments of FIGS. 1, 4 and 7.

A valve suitable to function as the pressure differential responsive valve device 40 is exemplified in FIG. 2 as including a pair of interconnected poppet type throttle valves 46 and 47 cooperable with valve seats 48 and 49 to control communication between a port 50 and a port 51 and between the latter port and the port 44. As valve 46 moves toward the seat 48 communication between ports 50 and 51 becomes more restricted, and as valve 47 simultaneously moves away from the seat 49 communication between ports 51 and 44 becomes less restricted. The two valves find movable support at one location from a small diaphragm 53 to which they are clamped via suitable means and share an operative connection to an operating diaphragm 54 which is subject opposingly to pressure of fluid from a port 55 connected to the supply line means 14 and from the port 50 which is connected to the common portion 41 of the return line means 22. A control spring 56 in the form of a helical compression spring acts on the valve assembly in a direction opposing supply line pressure, which also is a direction urging valve 47 towards its seat and valve 46 away from its seat. Port 51 is connected to return line portion 42 leading to the lower pump 43. Port 44 is open to the interior of the bell 12.

Figure 4:
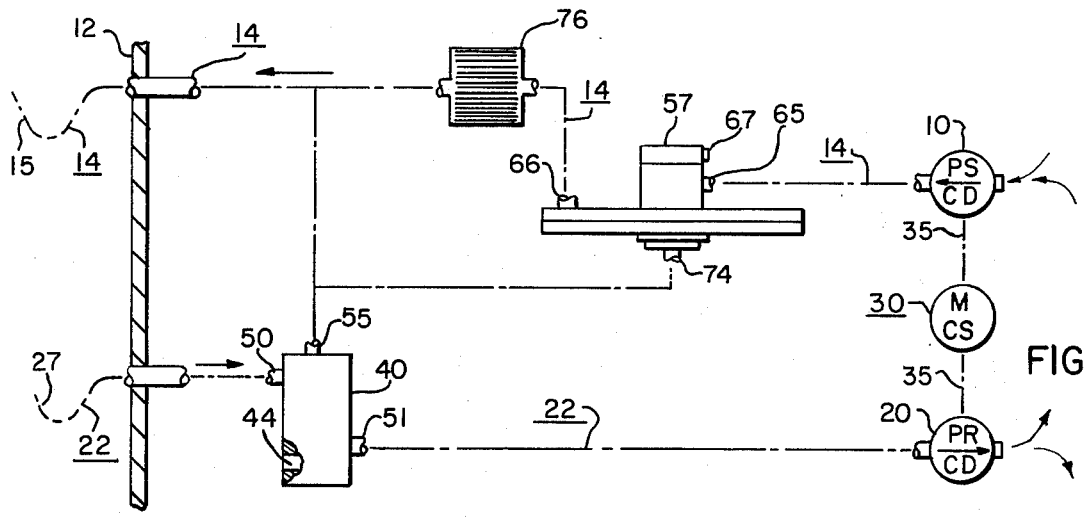

In the embodiment of the invention shown in FIG. 4, the volume rate of flow delivered to the supply line means is maintained constant by a flow responsive valve device 57 that controls supply from the pump means 10 and bypass of such supply back into the bell interior, at the same time that a constant differential in pressure is maintained between the supply line means 14 and the return line means 22 by the pressure differential responsive valve device 40 which functions to control the communication between the suction pump means 20 and the return line hose 27 and between such pump and bypass port 44; device 40 being like that shown in FIG. 2, for example.

Figure 5:
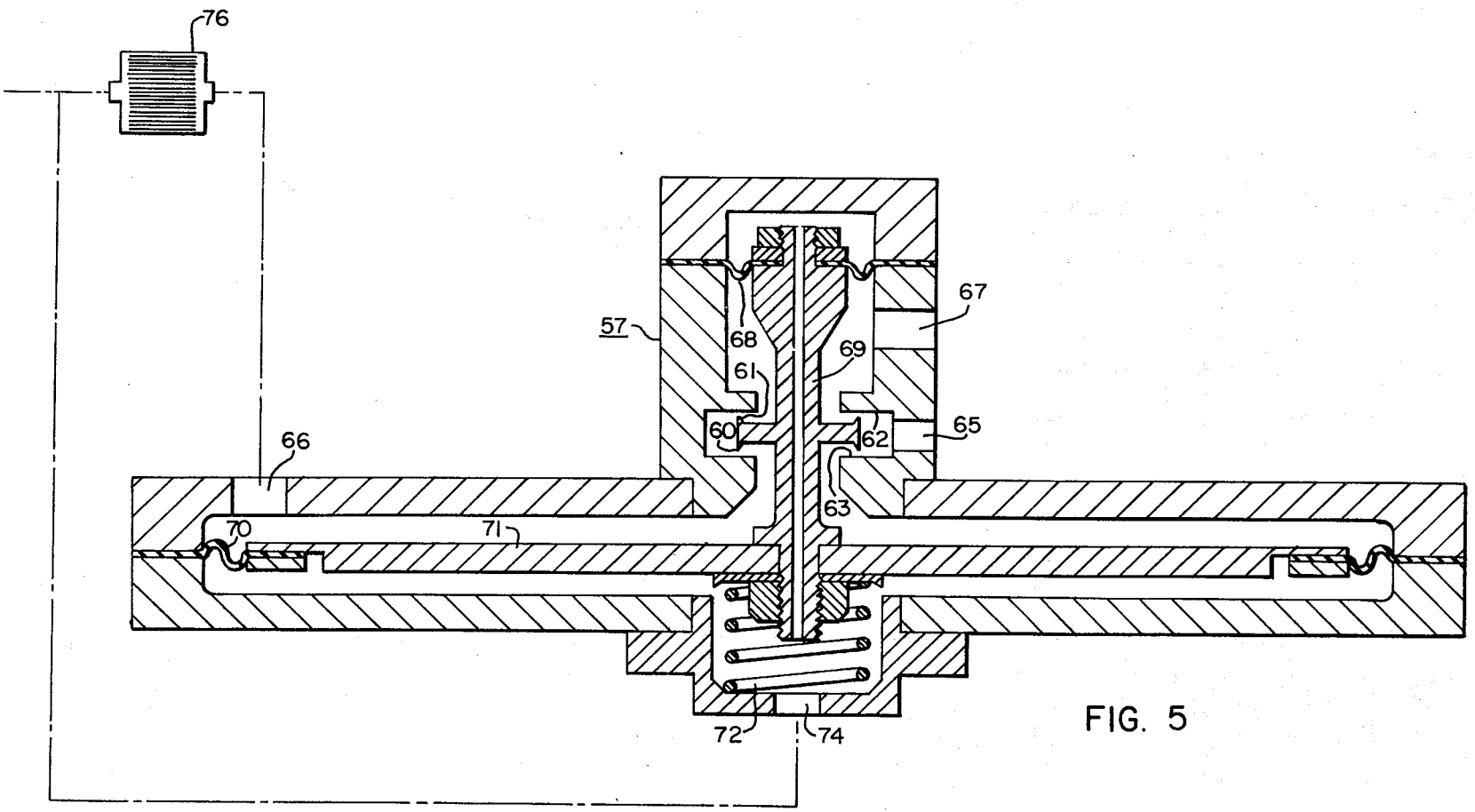

A suitable flow responsive valve device 57 is exemplified in FIG. 5 as including a pair of interconnected poppet type throttle valves 60 and 61 cooperable with valve seats 63 and 62 to control communication between a port 65 and a port 66 and between such port 65 and a port 67. As valve 60 moves toward the seat 63, communication between the ports 65 and 66 becomes more restricted, and as the valve 61 moves simultaneously away from the seat 62, communication between the port 65 and the port 67 becomes less restricted. The two valves find guided support at one location by a small diaphragm 68 clamped to a stem 69 attached to such valves. The valves are actuated by a large diaphragm 70 and follower piston 71 assembly attached to the stem 69. A control spring 72 in the form of a helical compression spring acts on the valve assembly in a direction urging the valve 61 toward its seat and the valve 60 away from its seat. To render the device 57 responsive to flow rate, the upper portion of the diaphragm piston 71 is subjected to pressure in the port 66, while the lower face of such piston is subjected to pressure in a port 74 connected to the supply line means 14 near its supply hose portion and to the port 66 via a parallel tube type flow restrictor 76 that develops a low-level pressure drop proportional to the rate of flow of breathing gas passing through it. Port 65 receives output from the supply pump means 10, and the port 67 opens into the interior of the bell 12. Flow to the supply hose 15 to furnish the diver with breathing gas takes place by way of the port 65, unseated valve 60, the upper side of the diaphragm-supported piston 71, the port 66, and the flow restrictor 76. The pressure drop across the restrictor 76 is a measure of the flow rate therethrough, hence the flow rate of breathing gas to the diver via hose 15, and such flow-rate pressure difference is experienced in the valve device across the piston 71 to regulate the position of the valves 60 and 61 relative to the seats 62 and 63 to maintain the breathing gas flow substantially constant as determined by the bias imposed by the control spring 72 acting on such piston. A slight excess flow results in movement of the valve 60 toward its seat 63 to reduce such excess enroute to the supply hose while the valve 61 moves away from seat 62 to shunt such excess as supplied by the pump means back into the interior of the bell via port means 67. A slight deficiency in breathing gas flow to the supply hose via restrictor 76 results in increasing the supply valve 60 opening and decreasing the bypass valve 61 opening to compensate for such flow deficiency automatically. At the same time, the pressure differential responsive valve device 40 automatically adjusts the degree of return pressure appearing in the return hose 27 from the diver by controlling communication between such return hose and the return pump means 20 via ports 50 and 51 and between such return hose and the interior of the bell via ports 50 and 44, as will be understood by reference to the previous description of FIG. 2. The electric motor means 30 in this FIG. 4 embodiment will be of the constant speed type and coupled to the supply and return pump means 10 and 20 by way of driving connection 35.

Figure 6:
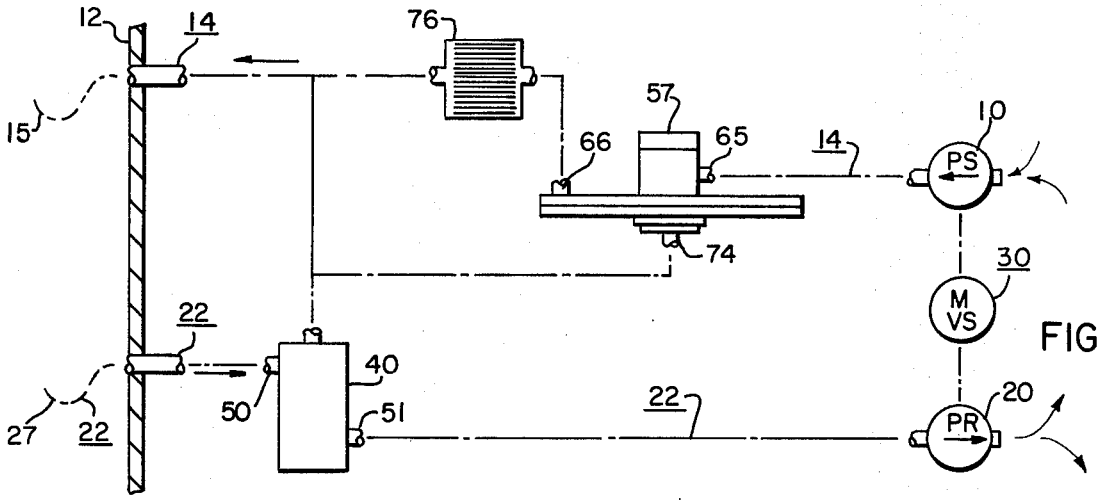

In the embodiment of FIG. 6, the flow responsive valve device 57 and the pressure differential responsive valve device 40 operates in a flow-throttling mode only, rather than throttling and bypass as in FIG. 4. This can be obtained, by way of illustration, by plugging the bypass port means 67 of device 57, and plugging the bypass port means 44 of device 40. By reference to FIGS. 2 and 5 in addition to FIG. 6, it will be understood that device 57 will operate to maintain flow of breathing gas to the supply hose 15 substantially constant by the throttling action between the supply control valve 60 and its seat 63, and that the device 40 will operate to regulate the pressure in the return hose 27 to maintain a constant supply-return pressure differential by throttling action of the valve 46 relative to the seat 48.

Figure 7:
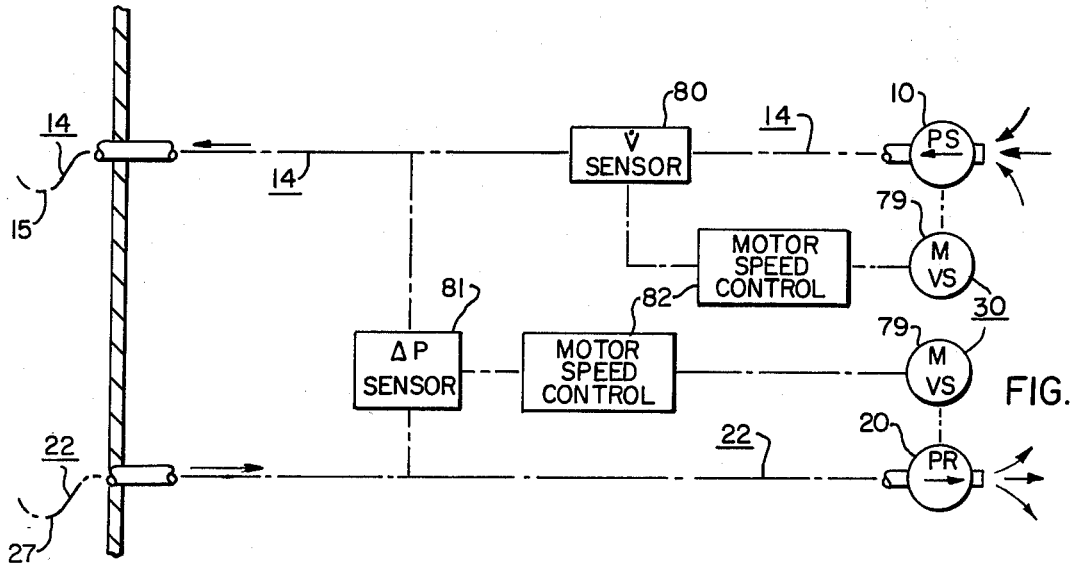

In the embodiment of FIG. 7, the supply pump means 10 and the return pump means 20 are operated by variable speed motors 79 and the flow of breathing gas from such supply pump means to the supply hose 15 is maintained constant by a flow sensitive device 80 and motor speed control 82 controls the energization, hence speed, of the respective motor driving such pump means. Such device 80 may take the well-known commercially-available form known as a turbine flow meter. At the same time, the output from the return pump means 20 is automatically controlled to maintain a constant particular pressure differential between the supply and return line means 14 and 22 by regulation of the speed of the respective drive motor 79 for the return pump means. A pressure-differential responsive electrical energy controlling device 81, in well-known form commonly referred to as differential pressure sensor and device 82, provides for such regulation of motor speed.

We claim:

1. Underwater breathing apparatus for a diver, comprising, a diver-worn device for introducing breathing gas to and from a submerged diver, a submerged chamber containing a source of breathing gas and relative to which bell the diver may change depth, pump means at said chamber for moving such gas simultaneously to and from said diver-worn device, motor means at said chamber for operating said pump means, flexible supply and return hose means extending between said pump means and said diver-worn device for conveying the gas being moved therebetween, exhaust control valve means at said diver-worn device for maintaining gas pressure therein at slightly above the surrounding hydrostatic pressure, and differential-pressure control means responsive to supply and return pressures of said gas in said hose means at said chamber for maintaining a substantially constant differential between such pressures in said hose means, respectively.

2. Underwater breating apparatus as set forth in claim 1, wherein said differential-pressure control means includes means controlling communication between said pump means and said hose means.

3. Underwater breathing apparatus as set forth in claim 1, wherein said differential-pressure control means includes means controlling communication between said hose means and said source in bypass of said pump means.

4. Underwater breathing apparatus as set forth in claim 1, wherein said differential-pressure control means includes means for controlling speed of operation of said motor means.

5. Underwater breathing apparatus of claim 1, wherein said pump means includes a plurality of return pumps and said differential-pressure control means includes means for controlling effectuation of the return pumps quantatively.

6. Underwater breathing apparatus as set forth in claim 1, wherein such apparatus further includes flow control means for maintaining volume flow of breathing gas to said hose means constant.

7. Underwater breathing apparatus as set forth in claim 6, wherein said flow control means comprises means controlling communication between said pump means and said hose means.

8. Underwater breathing apparatus as set forth in claim 6, wherein said flow control means includes means for controlling pump-bypassing communication between said pump means and said hose means.

9. Underwater breathing apparatus as set forth in claim 6, wherein said flow control means includes means for controlling speed of operation of said pump means with respect to its supply output.

* * * * *